US005591327A

United States Patent [19]

Walters

[11] Patent Number: 5,591,327

[45] Date of Patent: Jan. 7, 1997

[54] FLOTATION EQUIPMENT

[76] Inventor: Jeremy P. A. Walters, Portion 83, Lindley, District Krugersdorp, Transvaal Province, South Africa

[21] Appl. No.: 348,291

[22] Filed: Dec. 1, 1994

[30] Foreign Application Priority Data

Dec. 9, 1993 [ZA] South Africa ..... 93/9232

[51] Int. Cl.[6] ..... B03D 1/16

[52] U.S. Cl. ..... 209/169; 261/87; 261/93; 366/102

[58] Field of Search ..... 209/169; 261/87, 261/93; 366/102, 317, 316

[56] References Cited

U.S. PATENT DOCUMENTS

| | | |
|---|---|---|
| 2,148,445 | 2/1939 | Drake . |
| 2,246,559 | 6/1941 | Weinig . |
| 2,246,560 | 6/1941 | Weinig . |
| 2,436,375 | 2/1948 | Booth . |
| 3,700,103 | 10/1972 | Giebel . |
| 3,972,815 | 8/1976 | O'Cheskey . |
| 4,078,026 | 3/1978 | Fallenius . |
| 4,290,886 | 9/1981 | Takakuwa . |
| 4,508,619 | 4/1985 | Niitti . |
| 5,039,400 | 8/1991 | Kallioinen . |

FOREIGN PATENT DOCUMENTS

| | | |
|---|---|---|
| 899145 | 1/1982 | U.S.S.R. . |
| 904788 | 2/1982 | U.S.S.R. . |
| 832526 | 4/1960 | United Kingdom . |

OTHER PUBLICATIONS

"Introduction to Mineral Processing" by Kelly, E. and Spottiswood, D. pp. 301–307, Ch. 16, Copyright 1982, John Wiley & Sons.

*Primary Examiner*—Thomas M. Lithgow
*Attorney, Agent, or Firm*—Marshall, O'Toole, Gerstein, Murray & Borun

[57] ABSTRACT

The invention provides for flotation equipment which is locatable inside a container for a pulp to be subjected to a flotation process and a rotor or impeller or agitator rotatable within the container about a substantially vertical axis, the rotor including first means for imparting a radially upward pulp stream movement to pulp particles in the container, the first means being in the form of a set of arcuate surfaces located between the vanes and second means for moving air from atmosphere in a downward direction to below the pulp stream level in the container, the second means comprising a set of arcuate surfaces extending from the top of the rotor to outlets in the peripheral surfaces of the vanes.

2 Claims, 1 Drawing Sheet

FLOTATION EQUIPMENT

BACKGROUND TO THE INVENTION

Most froth flotation equipment comprises a tank for pulp, an agitator in the form of a rotor and means for introducing and dispersing air into the agitated pulp.

One of the objectives associated with flotation equipment is the maximisation of the pulp particle/air contact. As the pulp particles continuously fall under gravity and the air bubbles continuously rise it is often difficult to improve interaction and contact times. For this reason air is often supplied to the equipment under pressure and forcibly introduced into the tank.

A rotor can be used to provide a pumping or lifting action to the pulp. Thus, instead of merely agitating the pulp the rotor imparts a definite upward movement to the pulp thereby increasing the overall suspension time of pulp particles in the upper reaches of the tank and consequently improving contact times.

It must be understood that the term "rotor" as used in this specification is intended to include within its scope impellers and agitators and the term "pulp stream" is intended to refer to pulp pumped by the rotor.

An object of this invention is to provide flotation equipment in which air/particle contact times are improved without the necessity of using compressed air.

SUMMARY OF THE INVENTION

According to the invention froth flotation equipment includes a container for a pulp to be subjected to a flotation process, first means for imparting an upward movement to pulp particles and second means for moving air from above the pulp surface in a downward direction to below the pulp stream level in the container.

Further, according to the invention, the first and second means are provided by a rotor within the container and rotatable about a substantially vertical axis, and having radially extending vanes.

Further, according to the invention, the first and second means comprise a first set and second set of surfaces respectively on the rotor.

Still further, according to the invention, the first set of surfaces are of an arcuate form, extend radially with respect to the rotor axis and communicate with the bottom of the rotor.

Still further, according to the invention, the first set of surfaces are located between the vanes of the rotor.

Still further, according to the invention, the shape of the surfaces of the first set is to draw the particles up into the rotor and eject them from the rotor in a transverse direction at a position spaced from the bottom of the rotor to create the pulp stream.

Still further, according to the invention, the second set of surfaces are of an arcuate form, extend radially with respect to the axis and communicate with the top of the rotor.

Still further, according to the invention, the shape of the surfaces of the first set is to draw air downwardly from above the rotor into the rotor and eject the air from the rotor at a position spaced from the top of the rotor.

Still further, according to the invention, the first and second sets of surfaces are arranged such that the air is ejected from the rotor at a position below the position at which the particles are ejected from the rotor.

Still further, according to the invention, the surfaces of the second set are located in passages in the vanes, the passages having air inlets in the top of the rotor and air outlets in the outer vane surfaces.

The invention also provides a rotor as defined above.

BRIEF DESCRIPTION OF THE DRAWINGS

One embodiment of the invention described by way of example only follows with reference to the accompanying sketches in which.

DETAILED DESCRIPTION OF THE DRAWINGS

Figure 1:
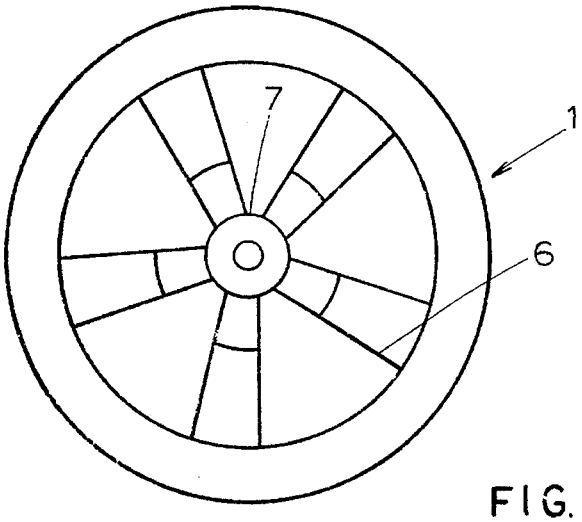
FIG. 1 is a plan of the underneath of a rotor according to the invention.
Figure 2:
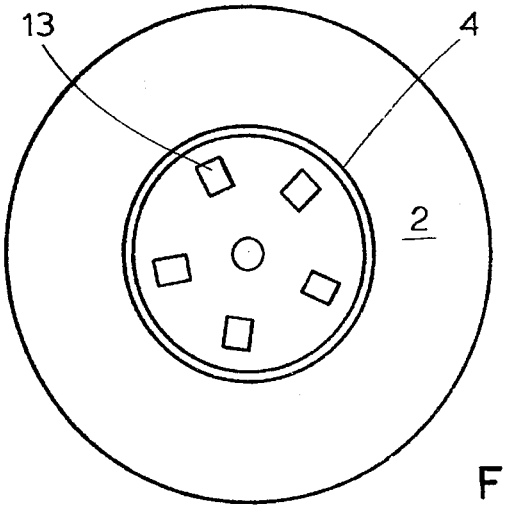
FIG. 2 is a plan of the top of the rotor.

In this embodiment of the invention froth flotation equipment (not shown) consists of a froth flotation container or tank of known type having a suitable discharge weir and pulp feeding means.

A rotor (1) is located within the tank and adapted to rotate about a vertical axis. The rotor (1) is cast in a polyurethane material.

The rotor (1) comprises a circular top member (2) and extending from the upper side (3) thereof is a short hollow cylindrical member (4). The cylindrical member (4) is coaxial with the top member (2).

Extending from the lower side (5) of the top member (2) are five radially extending vanes (6). Each of the vanes (6) tapers inwardly towards a central boss (7). The outer surface of each vane include a portion (8) which extends perpendicularly to the lower surface (5) of the top member (2) and a lower portion (9) which curves inwardly towards the boss (7).

Between each pair of vanes is a curved surface (10) which curve inwardly towards the boss from the outer top edge (11) of the surfaces (8). These surfaces (10) form a first set of surfaces and on rotation of the rotor cause pulp particles at the bottom of the tank to move upwardly and form a pulp stream in the direction of the arrows marked "X" and to be ejected from the rotor in an outward direction at a position just below the top member (3).

In each of the Vanes (6) is a passage (12) which extends from an inlet (13) in the top member (2) and located within the cylindrical member (4) to an outlet (14) in the surface (8) of the vane and near the bottom (15) thereof.

Figure 3:
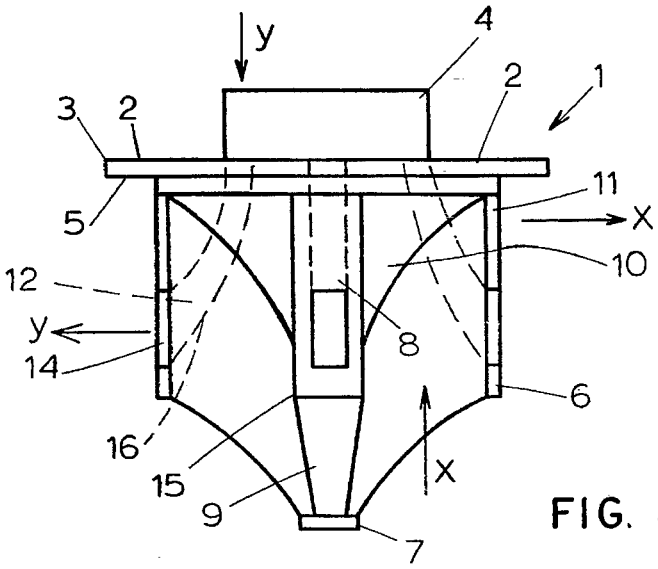
FIG. 3 is a side elevation of the rotor.

The passage includes a lower curved surface (16) and these surfaces (16) provide a second set of surfaces which, together with the passages (12) move air from above the rotor (1) into the inlet (13) through the passage (12) and out of the outlet (14). The passage with the air is shown by the letters "Y" in FIG. 3 of the drawings.

From the above it can be noted that the position at which the air is ejected into the pulp (ie the outlet (14)) is lower than the position at which the pulp particles are ejected from the rotor back into the pulp. Because of the tendency of pulp particles to move downwardly under gravity and the air bubbles to rise through the pulp an intimate mixing of the air bubbles and pulp particles occurs and this results in improved contact times and hence improved flotation results.

Other embodiments are envisaged within the scope of the invention including other configurations and applications thereof.

What I claim as new and desire to secure by Letters Patent is:

1. Froth flotation equipment comprising a container with an open top for containing a pulp to be subjected to a flotation process, and a multi-vaned rotor located in the container comprising a substantially circular top plate defining a rotor axis perpendicular to said plate at the center of the top, said plate having an upper side and a lower side, a plurality of radially extending vanes mounted to the lower side of the plate, a first arcuate surface located between each pair of adjacent vanes which curve inwardly and downwardly toward the axis from an outer top edge of said surface near the top of said vanes, said first surfaces are adapted to impart an upward movement of the pulp and eject the pulp in a direction transverse to the axis of said rotor, said rotor further includes passages therein, said passages extend from the upper side of said top plate to the outer edge of the vane at a position below the position at which the pulp is ejected from the rotor and comprise a second surface for moving air from above the rotor to the outer edge of the vane.

2. A multiple vaned rotor for use in froth flotation tank containing pulp, said rotor comprising a substantially circular top plate defining a rotor axis perpendicular to said plate at the center of the top, said plate having an upper side and a lower side, a plurality of radially extending vanes mounted to the lower side of the plate, a first arcuate surface located between each pair of adjacent vanes which curve inwardly and downwardly toward the axis from an outer top edge of said surface near the top of said vanes, said first surfaces are adapted to impart an upward movement of the pulp and eject the pulp in a direction transverse to the axis of said rotor, said rotor further includes passages therein, said passages extend from the upper side of said top plate to the outer edge of the vane at a position below the position at which the pulp is ejected from the rotor and comprise a second surface for moving air from above the rotor to the outer edge of the vane.

* * * * *